US005186154A

United States Patent [19]

Takaishi et al.

[11] Patent Number: 5,186,154

[45] Date of Patent: Feb. 16, 1993

[54] IGNITION COIL DEVICE FOR AN INTERNAL COMBUSTION ENGINE

[75] Inventors: Tadao Takaishi; Toshio Maekawa, both of Himeji, Japan

[73] Assignee: Mitsubishi Denki K.K., Tokyo, Japan

[21] Appl. No.: 699,402

[22] Filed: May 13, 1991

[30] Foreign Application Priority Data

| | | | |
|---|---|---|---|
| May 15, 1990 | [JP] | Japan | 2-122993 |
| Jun. 7, 1990 | [JP] | Japan | 2-147337 |
| Jun. 11, 1990 | [JP] | Japan | 2-149837 |
| Jun. 11, 1990 | [JP] | Japan | 2-149838 |

[51] Int. Cl.[5] ..... F02P 3/02

[52] U.S. Cl. ..... 123/634; 123/647

[58] Field of Search ..... 123/634, 635, 647

[56] References Cited

U.S. PATENT DOCUMENTS

| | | | |
|---|---|---|---|
| 4,248,201 | 2/1981 | Tsutsui et al. | 123/634 |
| 4,951,641 | 8/1990 | Takaishi et al. | 123/634 |
| 5,003,959 | 4/1991 | Umezaki et al. | 123/634 |
| 5,044,328 | 9/1991 | Umezaki | 123/647 |

FOREIGN PATENT DOCUMENTS

| | | | |
|---|---|---|---|
| 3309986 | 9/1984 | Fed. Rep. of Germany . | |
| 8616484 | 9/1986 | Fed. Rep. of Germany . | |
| 3933302 | 4/1990 | Fed. Rep. of Germany | 123/635 |
| 58-29612 | 6/1983 | Japan . | |
| 58-30133 | 7/1983 | Japan . | |
| 2-103913 | 4/1990 | Japan . | |
| 1229930 | 4/1971 | United Kingdom . | |

OTHER PUBLICATIONS

Ignition Coil for Internal Combustion Engine Abstract of JP 62-33409, Feb. 1987.

*Primary Examiner*—Andrew M. Dolinar

*Attorney, Agent, or Firm*—Sughrue, Mion, Zinn, Macpeak & Seas

[57] ABSTRACT

An ignition coil device for an internal combustion engine includes an air gap between the two heat generating sources, the coil assembly and the power transistor unit, such that the coil assembly and the power transistor unit are thermally isolated from each other. Further, the primary winding bobbin has an inner projection inserted into the air gap of the core to maintain the gap. Furthermore, the primary winding bobbin and the secondary winding bobbin each has a first and a second bobbin attachment portion. First the high voltage tower attachment portion of the high voltage tower is engaged with the bobbin attachment portion on the secondary winding bobbin and the connector attachment portion of the connector is engaged with the bobbin attachment portion on the primary winding bobbin, to form respective integral sub-units. Then, the second bobbin attachment portion on the primary winding bobbin is engaged with the second bobbin attachment portion on the secondary winding bobbin, to form an integral assembly, which is then inserted into the mold resin casing after the necessary electrical connections are made outside of the mold resin casing. The interior wiring for connecting the power transistor unit to the connector extend outside of the core such that adverse effects of the flux in the core on the interior wiring is prevented.

3 Claims, 10 Drawing Sheets

IGNITION COIL DEVICE FOR AN INTERNAL COMBUSTION ENGINE

BACKGROUND OF THE INVENTION

This invention relates to ignition coil devices for internal combustion engines by which an ignition coil and a control circuit are accommodated in the accommodating chamber and the pocket of a mold resin casing, respectively.

FIG. 1 is a circuit diagram showing the fundamental circuit structure of an ignition coil device for an internal combustion engine. The circuit includes an ignition coil 1 and an igniter 2, which consists of a control unit 2*a* and a power transistor 2*b*. FIG. 2 is an end view of an ignition coil device disclosed in Japanese Patent Application No. 63-255831; FIG. 3 shows a section of an ignition coil device of FIG. 2 along the line III—III of FIG. 4; and FIG. 4 is a side view of an ignition coil device of FIG. 2. A heat sink 4 is attached at its bottom fixing plate 41 to the core 3. The core 3 and the heat sink 4 are secured to a mold resin casing 5, which encloses an accommodating chamber 51 therein. The mold resin casing 5 exposes via its windows 53*a* and 53*b* portions 42*a* and 42*b* of the heat sink 4. A power transistor unit 6 (implementing the igniter 2 of FIG. 1) is accommodated within a pocket 52 of the mold resin casing 5.

The coil assembly 7 includes a primary winding wound on the primary winding bobbin 71*a* and a secondary winding wound on the secondary winding bobbin 71*b*. A high voltage tower 8 is provided with terminals for leading out to the exterior the high voltage induced in the secondary winding of the coil assembly 7. A connector 9 provides an electrical connection from the power transistor unit 6 to exterior circuits. By the way, a resin material is filled in the remaining space within the accommodating chamber 51 and the pocket 52 of the mold resin casing 5.

The method of operation of the above ignition coil device is as follows. In response to control signals supplied via the connector 9, the power transistor unit 6 turns off the primary current flowing through the primary winding of the coil assembly 7. The high voltage induced in the secondary winding is supplied via the high voltage tower 8 to a distributor of the internal combustion engine.

The heat generated in the power transistor unit 6 is transmitted through the heat sink 4 and is radiated from the exposed portions 42*a* and 42*b* via the windows 53*a* and 53*b*, or directly from the core 3. The heat generated in the primary winding and the secondary winding is primarily radiated from the core 3.

The above ignition coil device has the following disadvantage.

Since the heating generating power transistor unit 6 and the coil assembly 7 are disposed close to each other within a compact casing, the heat generated by them is accumulated. The power transistor unit 6 and the coils of the coil assembly 7 are heated to a high temperature and may thus burn and fail.

FIG. 5 is a view similar to that of FIG. 3, but showing another ignition coil device; and FIG. 6 shows a section along the line VI—VI of FIG. 5. The structure of the ignition coil device of FIGS. 5 and 6 is similar to that shown in FIGS. 1 through 4, where like reference numerals represent like parts. However, the primary winding 7*a* and the secondary winding 7*b* wound on the primary winding bobbin 71*a* and the secondary winding bobbin 71*b*, respectively, are shown explicitly in FIG. 6.

The ignition coil device of FIGS. 5 and 6 has the following disadvantage.

A too large inductance of the core 3 slows down the rising speed of the secondary current. Thus, for the purpose of decreasing the inductance of the core 3 and thereby increasing the rising speed of the secondary current, a spacer 3*a* is inserted across a leg of the core 3. This insertion of the spacer 3*a* entails increase in the production cost and the number of assembly steps.

FIGS. 7 through 9 show still another conventional ignition coil device similar to that shown in FIGS. 1 through 4, like reference numeral representing like parts.

FIG. 10 is an exploded view of another ignition coil device similar to that of FIGS. 7 through 9. The high voltage tower 8 is attached at the high voltage tower attachment portion 8*a* to the secondary winding 7*b* of the secondary winding bobbin 71*b*. The connector 9 is attached at the connector attachment portion 9*a* to the bobbin attachment portion 7*c* of the primary winding bobbin 71*a*. The assembling of the ignition coil device of FIG. 10 is effected as follows.

First, the high voltage tower attachment portion 8*a* of the high voltage tower 8 is engaged with the bobbin attachment portion 7*d* on the secondary winding bobbin 71*b*, such that the high voltage tower 8 and the secondary winding 7*b* wound on the secondary winding bobbin 71*b* form an integral unit. The high voltage tower 8 and the secondary winding 7*b* are electrically connected to each other via solder. Second, the connector attachment portion 9*a* of the connector 9 is engaged with the bobbin attachment portion 7*c* on the primary winding bobbin 71*a*, such that the connector 9 and the primary winding 7*a* wound on the primary winding bobbin 71*a* form an integral unit. The connector 9 and the primary winding 7*a* are electrically connected to each other via solder. The first and the second integral units thus obtained are accommodated within the mold resin casing 5, and, thereafter, electrical connections between the connector 9 and the secondary winding 7*b* and between the high voltage tower 8 and the secondary winding 7*b* are effected.

The ignition coil device of FIG. 10 has the following disadvantage.

The electrical connections between the connector 9 and the secondary winding 7*b* and between the high voltage tower 8 and the secondary winding 7*b* must be effected after the first and the second integral units are accommodated within the mold resin casing 5. Much time is needed for the interior wiring operations, and hence the assembling efficiency is low.

FIG. 11 is a view similar to that of FIG. 4, but showing still another ignition coil device; and FIG. 12 is a schematic sectional end view of the ignition coil device of FIG. 11. The ignition coil device of FIGS. 11 and 12 is also similar to that of FIGS. 1 through 4, where like reference numerals represent like parts. However, FIG. 12 shows the electrical connections to the power transistor unit 6 explicitly. A first terminal 10 of the power transistor unit 6 is coupled to a drive signal line 11 forming an interior wiring for controlling the primary winding 7*a*. A second terminal 12 of the power transistor unit 6 is connected to the ground line 13 forming part of the interior wiring of the ignition coil device. A third terminal 14 of the power transistor unit 6 is coupled to the primary winding 7*a*.

The ignition coil device of FIGS. 11 and 12 has the following disadvantage.

Since the ground line 13 runs through the interior of the core 3 forming the magnetic path of the ignition coil device, a voltage is induced by the flux passing through the core 3. If, for example, a negative voltage is induced in the ground line 13 at the time when an output voltage is generated in the secondary winding *7b*, the power transistor unit 6 may be turned on due to the lowering voltage at the ground line 13. The output voltage of the secondary winding *7b* may thus be reduced.

SUMMARY OF THE INVENTION

It is therefore an object of this invention to provide an ignition coil device for an internal combustion engine by which the mutual heating of the power transistor unit (or igniter) and the coil assembly can be effectively prevented.

A further object of this invention is to provide an ignition coil device for an internal combustion engine by which the production cost and the number of assembling steps are reduced.

A still further object of this invention is to provide an ignition coil device for an internal combustion engine by which the interior wirings are immune to adverse effects of the magnetic flux passing through the core, such that reliable error-free operation is ensured.

The first object is accomplished in accordance with the principle of this invention by an ignition coil device for an internal combustion engine, comprising: a mold resin casing enclosing an accommodating chamber and a pocket portion at a side of the accommodating chamber, wherein an air gap is formed between said accommodating chamber and pocket portion; a coil assembly accommodated within said accommodating chamber of the mold resin casing; a control circuit unit for controlling said coil assembly, disposed in said pocket portion of the mold resin casing; a core carrying said coil assembly wound thereon, said core having a leg exposed outside of said mold resin casing; and a heat sink extending within said pocket and in thermal contact with said control circuit unit, said heat sink being attached at one end thereof to said exposed leg of the core. Preferably, the mold resin casing has a window formed in a side wall of said pocket portion, and the heat sink extends between said control circuit unit and said window and in thermal contact with the control circuit unit at an inner side surface thereof, said heat sink being exposed to the exterior via said window at an outer surface thereof.

The second object is accomplished by an ignition coil device for an internal combustion engine, comprising: an iron core having an air gap formed across a leg thereof; a primary winding wound on a primary winding bobbin carried on said leg of the core having the air gap thereacross, wherein said primary winding bobbin has an inner projection inserted into said air gap across the leg of the core to maintain said air gap; and a secondary winding wound on a secondary winding bobbin disposed around said primary winding. Preferably, the inner projection has a form of an inner annular flange inserted into said air gap of the core.

The second object is also accomplished by an ignition coil device for an internal combustion engine, comprising: a mold resin casing enclosing therewithin an accommodating chamber; a primary winding wound on a primary winding bobbin having a first and a second bobbin attachment portion formed on a side thereof; a secondary winding wound on a secondary winding bobbin surrounding said primary winding, said secondary winding bobbin having a first and a second bobbin attachment portion formed on a side thereof, wherein said second bobbin attachment portion on the primary winding bobbin is engaged with said second bobbin attachment portion on the secondary winding bobbin; a connector for exterior electrical connection, electrically coupled to said primary winding and secondary winding, said connector having a connector attachment portion engaged with said first bobbin attachment portion on the primary winding bobbin; and a high voltage tower electrically coupled to said secondary winding, said high voltage tower having a high voltage tower attachment portion engaged with said first bobbin attachment portion on the secondary winding bobbin.

The above ignition coil device may be assembled by a method which comprises the steps of: preparing said mold resin casing, primary winding wound on said primary winding bobbin, secondary winding wound on said secondary winding bobbin, high voltage tower, and connector; engaging said high voltage tower attachment portion on the high voltage tower with said bobbin attachment portion on the secondary winding bobbin to form a first integral sub-unit of the high voltage tower and the secondary winding bobbin carrying the secondary winding; engaging said connector attachment portion of the connector with said bobbin attachment portion on the primary winding bobbin to form a second integral sub-unit of the high voltage tower and the secondary winding bobbin carrying the primary winding; engaging said second bobbin attachment portion of the primary winding bobbin with said second bobbin attachment portion of the secondary winding bobbin to form an integral assembly of said first and second sub-units; making electrical connections between said primary winding, secondary winding, high voltage tower, and connector; and accommodating said integral assembly into said accommodating chamber of the mold resin casing.

The third object is accomplished by an ignition coil device for an internal combustion engine, comprising: a mold resin casing; an iron core having a leg extending within said mold resin casing; a primary winding and a secondary winding wound on said leg of the core extending within said mold resin casing, said primary winding and secondary winding being accommodated within said mold resin casing; a control circuit unit for controlling primary current flowing through said primary winding; and a connector for exterior electrical connection, electrically coupled to said primary winding and secondary winding via an interior wiring; wherein said interior wiring is disposed outside of said leg of the core such that the interior wiring does no link with the magnetic flux of the core.

BRIEF DESCRIPTION OF THE DRAWINGS

The features which are believed to be characteristic of this invention are set forth with particularity in the appended claims. The structure and method of operation of this invention itself, however, will be best understood from the following detailed description, taken in conjunction with the accompanying drawings, in which:

In the drawings, like reference numerals represent like or corresponding parts or portions.

DETAILED DESCRIPTION OF THE PREFERRED EMBODIMENTS

Referring now to the accompanying drawings, the preferred embodiments of this invention are described.

Figure 1:
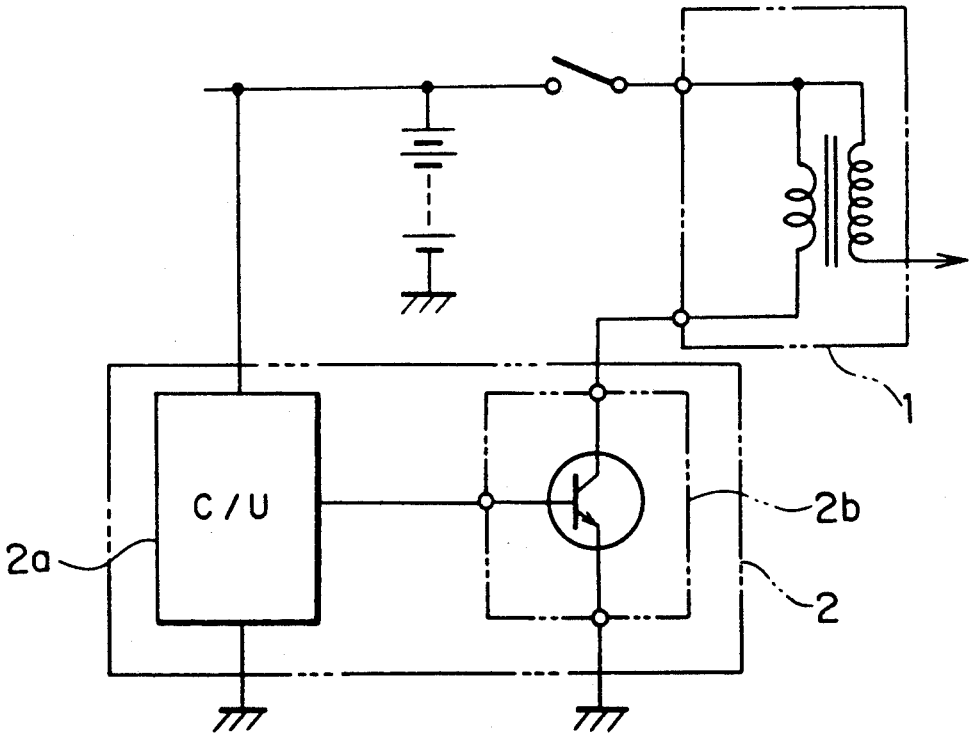
FIG. 1 PRIOR ART
FIG. 1 is a circuit diagram showing the fundamental circuit structure of an ignition coil device for an internal combustion engine.
Figure 2:
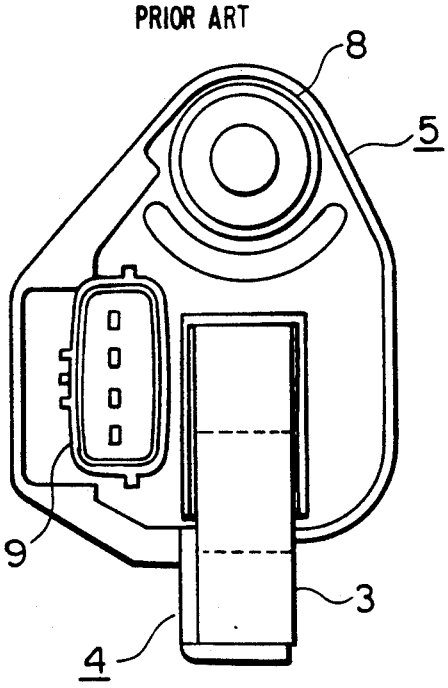
FIG. 2 PRIOR ART
FIG. 2 is an end view of an ignition coil device.
Figure 3:
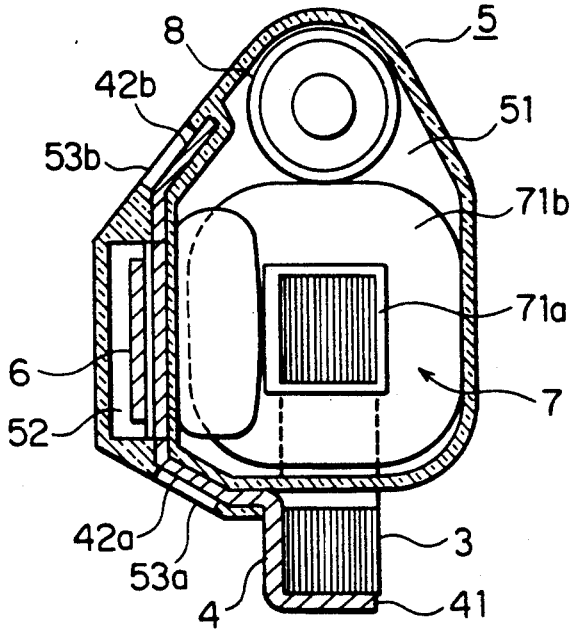
FIG. 3 PRIOR ART
FIG. 3 shows a section of an ignition coil device of FIG. 2 along the line III—III of FIG. 4.
Figure 4:
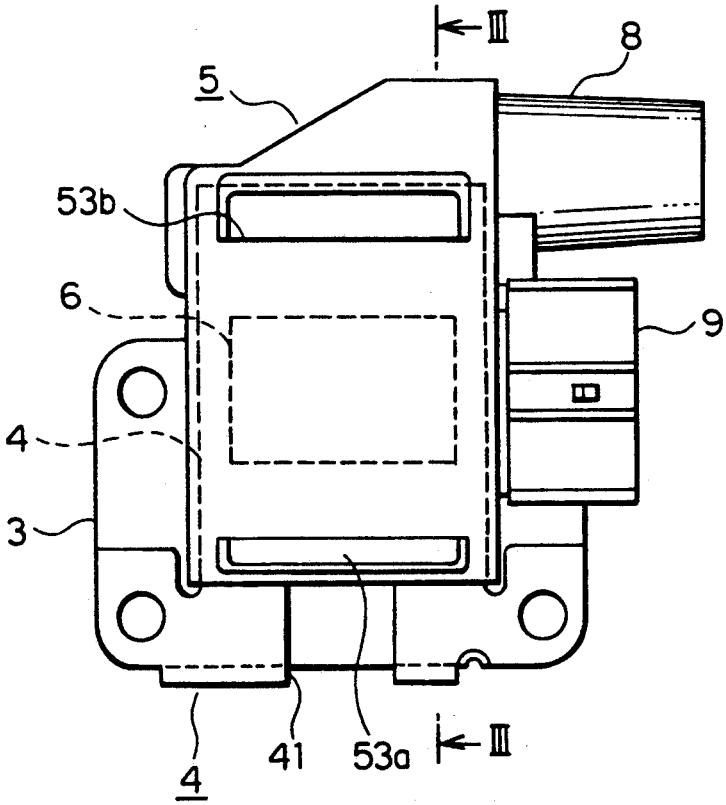
FIG. 4 PRIOR ART
FIG. 4 is a side view of an ignition coil device of FIG. 2.
Figure 13:
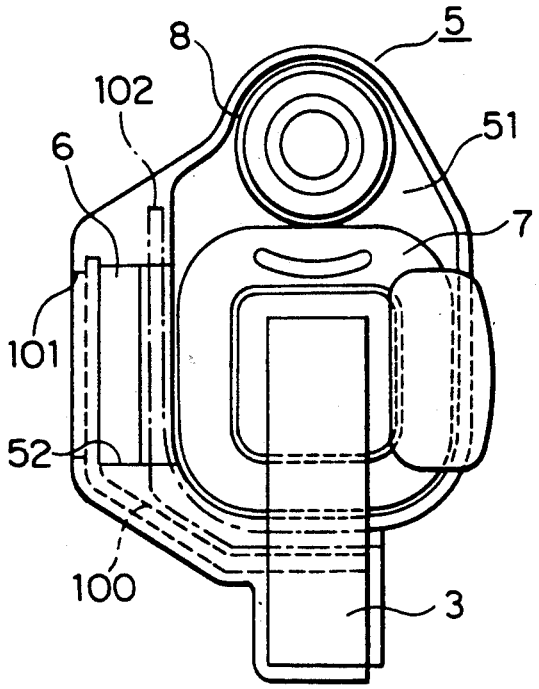
FIG. 13 is a front end view of an ignition coil device for an internal combustion engine according to this invention.
Figure 14:
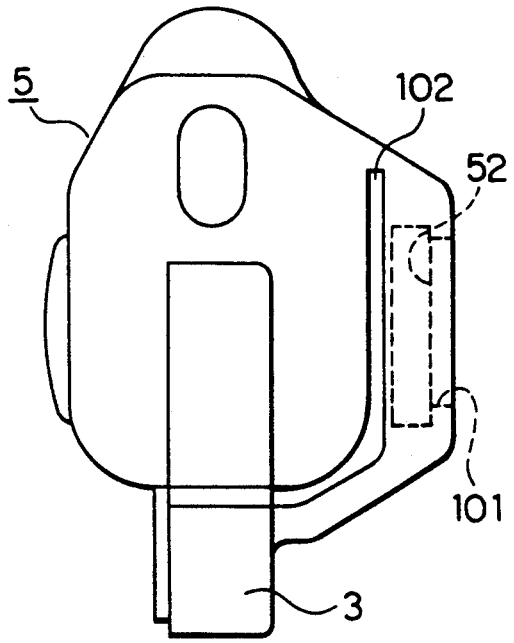
FIG. 14 is an back end view of an ignition coil device of FIG. 13.

FIG. 13 is a front end view of an ignition coil device for an internal combustion engine according to an embodiment of this invention. FIG. 14 is an back end view of an ignition coil device of FIG. 13. The ignition coil device is similar to that of FIGS. 2 through 4, wherein like parts are designated by like reference numerals and the description thereof is omitted.

In FIGS. 13 and 14, the heat sink 100 attached to the core 3 at the bottom end portion thereof extends between the power transistor unit 6 and a window 101 formed in a side wall of the pocket portion 52 of the mold resin casing 5. Thus, the heat sink 100, which is in thermal contact with the power transistor unit 6, is exposed to the exterior via the window 101. An air gap 102 is formed between the pocket portion 52 accommodating the power transistor unit 6 and the accommodating chamber 51 accommodating the coil assembly 7.

The heat generated in the power transistor unit 6 is transmitted through the heat sink 100 and is radiated via the window 101 or directly from the core 3. The heat generated in the primary winding and the secondary winding of the coil assembly 7 is radiated primarily from the core 3.

Since an air gap 102 is interposed between the two heat generating sources, power transistor unit 6 and coil assembly 7, the heat generated by the two sources are separated and the heat generated by the one does not raise the temperature of the other. Thus, the power transistor unit 6 and the coils of the coil assembly 7 are not susceptible to burning failures.

In the above embodiment, the power transistor unit 6 is used as the control circuit unit for the ignition coil device. However, it goes without saying that the control circuit unit is not limited to a power transistor unit.

Figure 5:
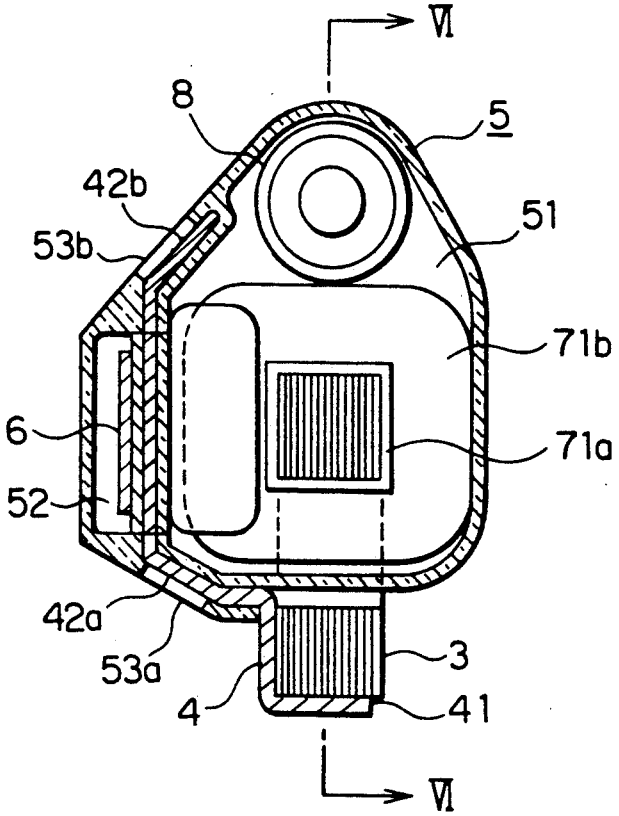
FIG. 5 PRIOR ART
FIG. 5 is a view similar to that of FIG. 3, but showing another ignition coil device.
Figure 6:
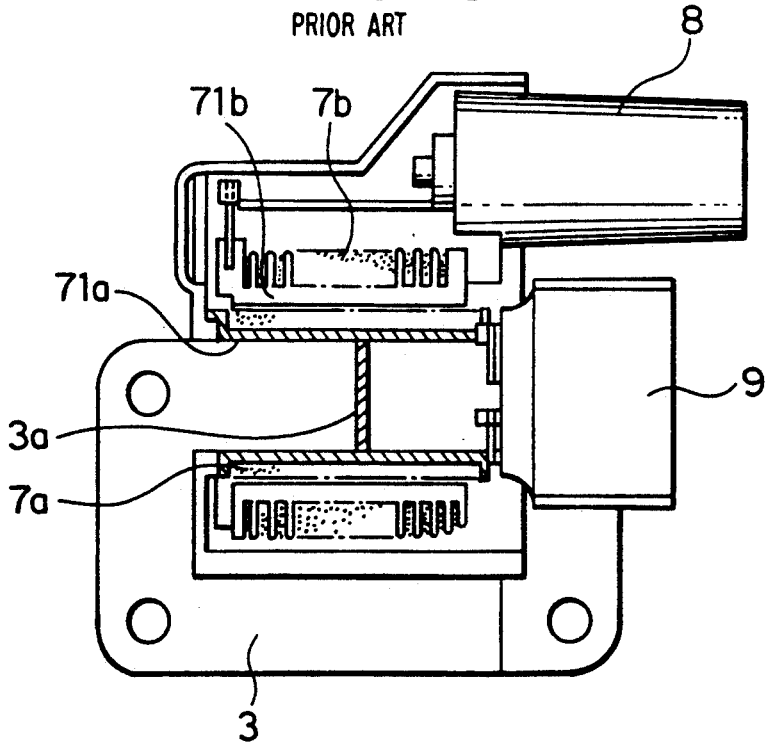
FIG. 6 PRIOR ART
FIG. 6 shows a section along the line VI—VI of FIG. 5.
Figure 7:
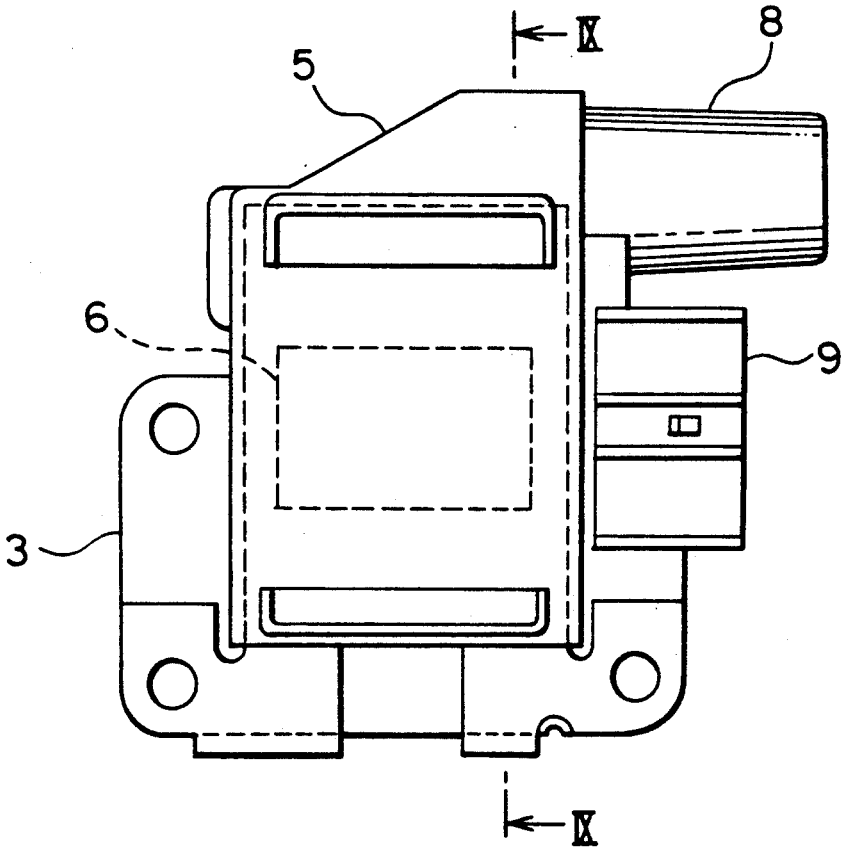
FIG. 7 PRIOR ART
FIG. 7 is a view similar to that of FIG. 4, but showing another ignition coil device.
Figure 15:
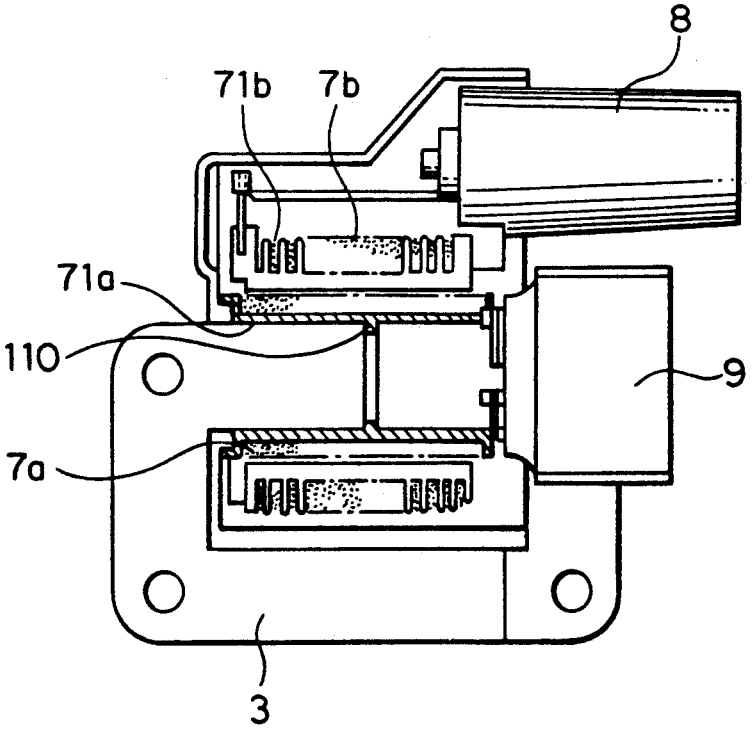
FIG. 15 is a side sectional view of another embodiment according to this invention.

FIG. 15 is a side sectional view of another embodiment according to this invention. The ignition coil device is similar to that of FIGS. 5 and 6, wherein like parts are designated by like reference numerals and the description thereof is omitted.

In FIG. 15, the primary winding bobbin 71*a* has an inner projection or flange 110, which projects into, and thereby maintains, the gap of the core 3. Thus, the inner projection 110 is utilized instead of the spacer 3*a* of FIG. 6. Thus, the gap thus maintained by the projection 110 limits the inductance of the core 3. Hence the rise time of the secondary current is shortened.

Figure 10:
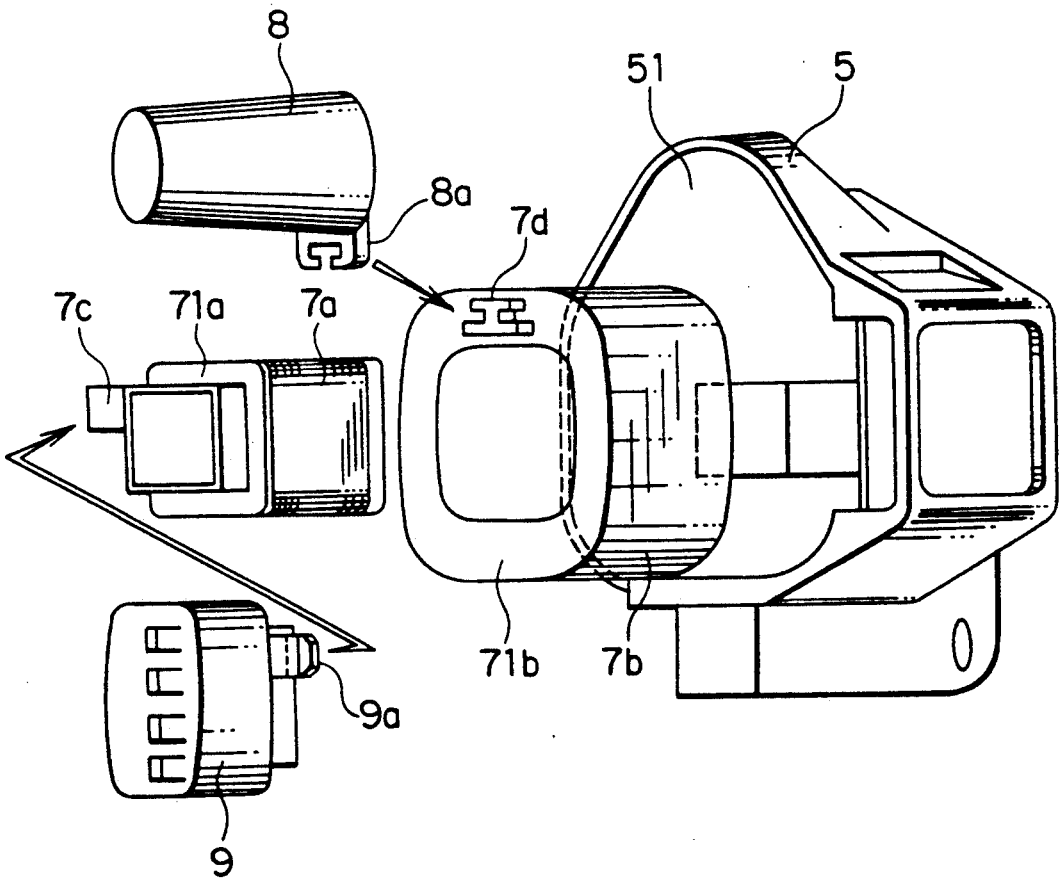
FIG. 10 is an exploded view of another ignition coil device which has a structure similar to that of FIGS. 7 through 9.
Figure 16:
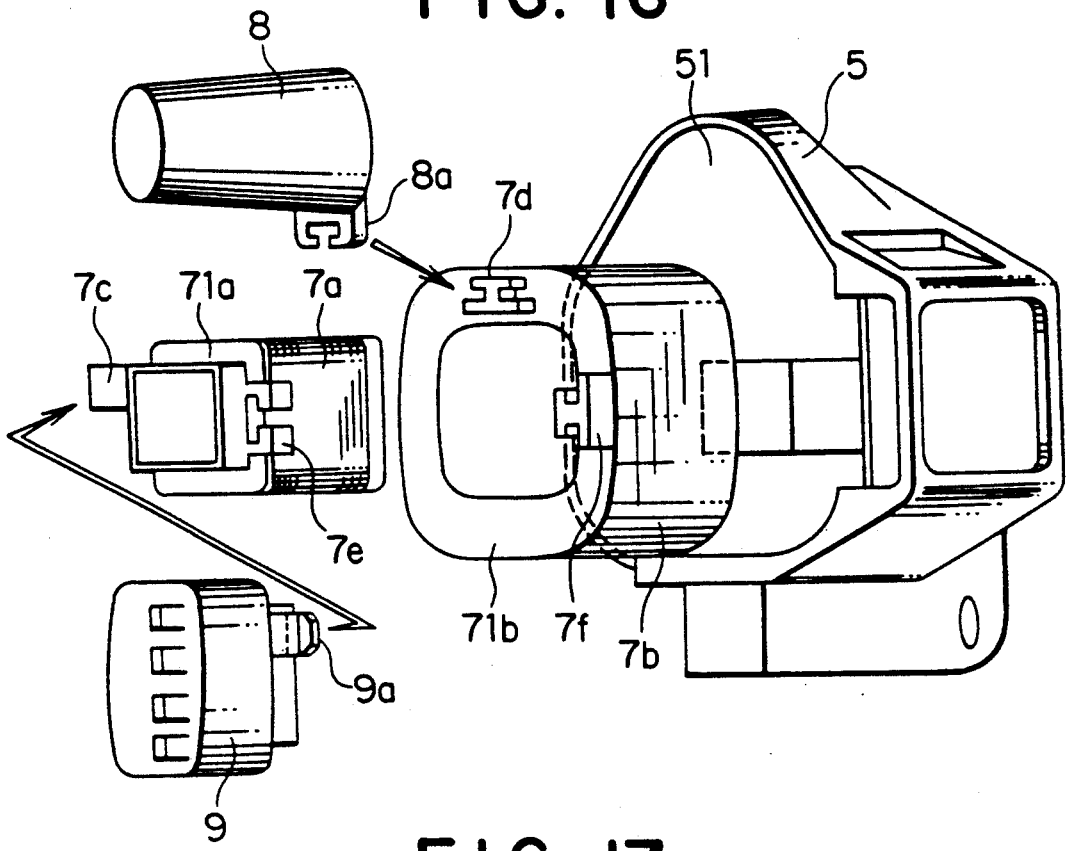
FIG. 16 is an exploded view of another embodiment according to this invention, by which interior wiring operations are simplified.
Figure 17:
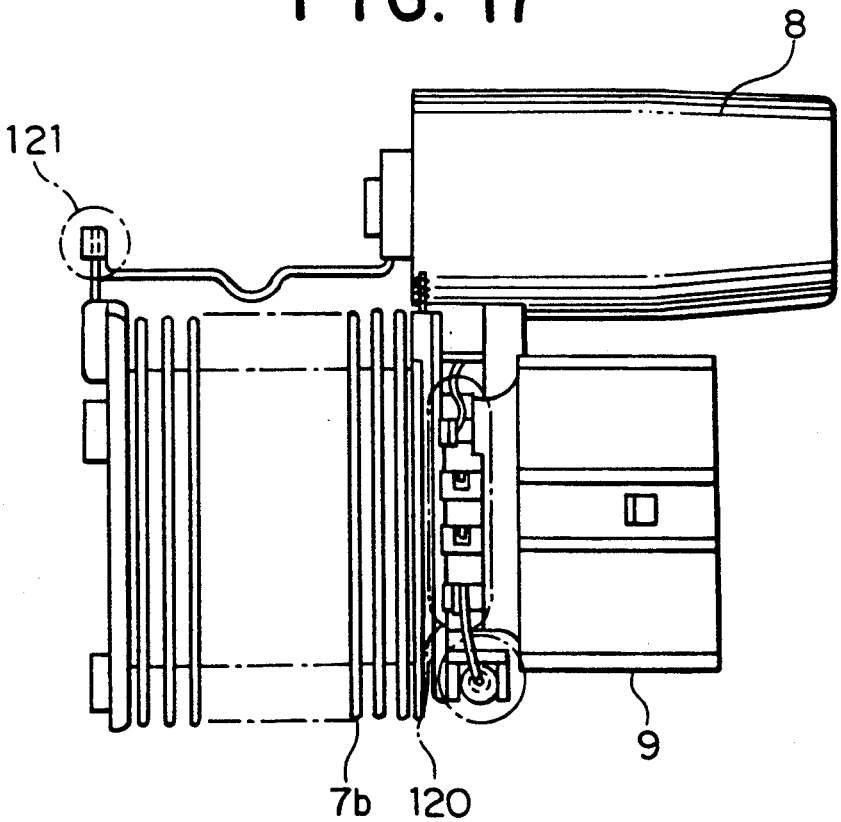
FIG. 17 is a side view of coil assembly, high voltage tower, and connector, assembled into a single integral unit, which are inserted into the mold resin casing of the ignition coil device of FIG. 16.
Figure 18:
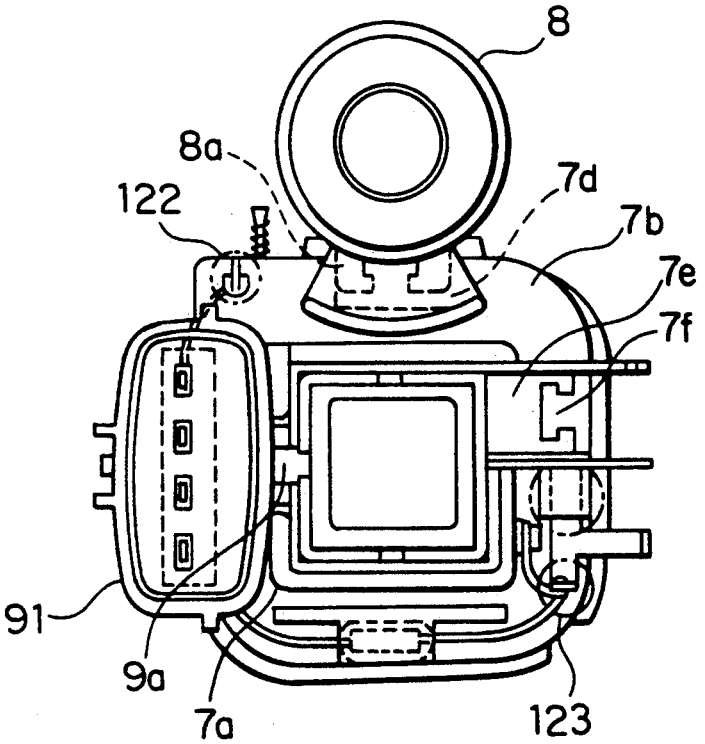
FIG. 18 is an end view of the assembly of FIG. 17 as viewed from the right.

FIG. 16 is an exploded view of another embodiment according to this invention, by which interior wiring operations are simplified. FIG. 17 is a side view of coil assembly, high voltage tower, and connector, assembled into a single integral unit, which is inserted into the mold resin casing of the ignition coil device of FIG. 16. FIG. 18 is an end view of the assembly of FIG. 17 as viewed from the right. The ignition coil device is similar to that of FIG. 10, wherein like parts are designated by like reference numerals and the description is omitted.

As shown clearly in FIG. 16, in addition to the bobbin attachment portion 7*c*, a second bobbin attachment portion 7*e* is formed on an end the primary winding bobbin 71*a*. Further, in addition to the bobbin attachment portion 7*d*, the secondary winding bobbin 71*b* is provided with a second bobbin attachment portion 7*f*, which engage with the second bobbin attachment portion 7*e* on the primary winding bobbin 71*a*.

Figure 8:
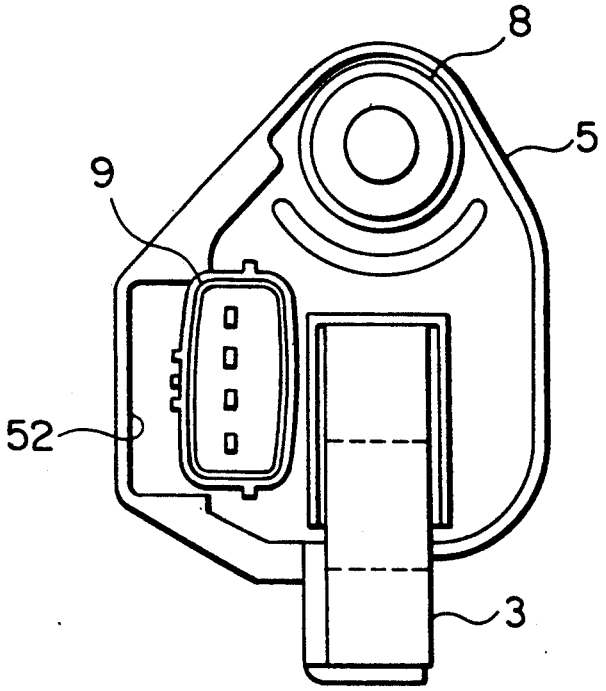
FIG. 8 PRIOR ART
FIG. 8 is an end view of the ignition coil device of FIG. 7.
Figure 9:
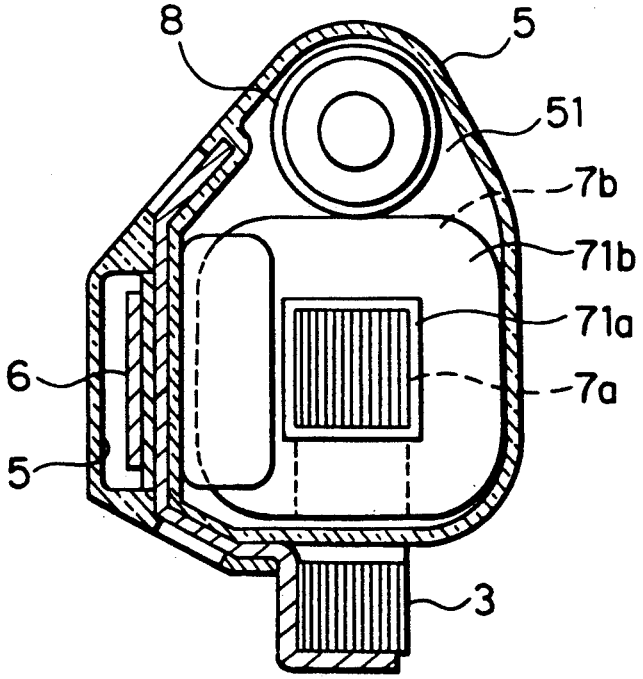
FIG. 9 PRIOR ART
FIG. 9 shows a section along the line IX—IX of FIG. 7.

The assembling of the ignition coil device of FIG. 16 is effected as shown in FIGS. 17 and 18. First, the high voltage tower attachment portion 8*a* of the high voltage tower 8 is engaged with the bobbin attachment portion 7*d* on the secondary winding bobbin 71*b*, such that the high voltage tower 8 and the secondary winding 7*b* wound on the secondary winding bobbin 71*b* form a first integral sub-unit. Second, the connector attachment portion 9*a* of the connector 9 is engaged with the bobbin attachment portion 7*c* on the primary winding bobbin 71*a*, such that the connector 9 and the primary winding 7*a* wound on the primary winding bobbin 71*a* form a second integral sub-unit. Next, the second bobbin attachment portion 7*e* on the primary winding bobbin 71*a* is engaged with the second bobbin attachment portion 7*f* on the secondary winding bobbin 71*b*, to obtain an integral assembly unit. Thereafter, the electrical connections are made by means of soldering at such portions as: the first wiring connection portion 120 where the connector 9 and the wirings therefor are connected to each other, the second wiring connection portion 121 where the secondary winding 7*b* and the high voltage tower 8 are connected to each other, the third wiring connection portion 122 where the wirings extending from the connector 9 are connected to the secondary winding *7b*, the fourth wiring connection portion 123 where the wirings extending from the connector 9 are connected to the primary winding *7a*. Thus, the first and the second sub-units are connected to each other electrically as well as physically. The integral assembly of the first and the second sub-units which have thus been assembled electrically as well as physically is inserted and accommodated within the mold resin casing 5. Thereafter, the core (not shown in FIGS. 16 through 18) is mounted, in a manner similar to that, for example, shown in FIGS. 8 and 9.

As described above, the primary winding, the secondary winding, the high voltage tower 8, and the connector 9 are assembled, both physically and electrically, outside of the mold resin casing 5. Thus, the assembling efficiency of the ignition coil device is greatly enhanced.

In the case of the above embodiment of FIGS. 16 through 18, the power transistor unit or igniter is accommodated within the mold resin casing 5. However, the structure according to this embodiment is applicable to the case where the igniter is disposed outside of the mold resin casing 5.

Figure 11:
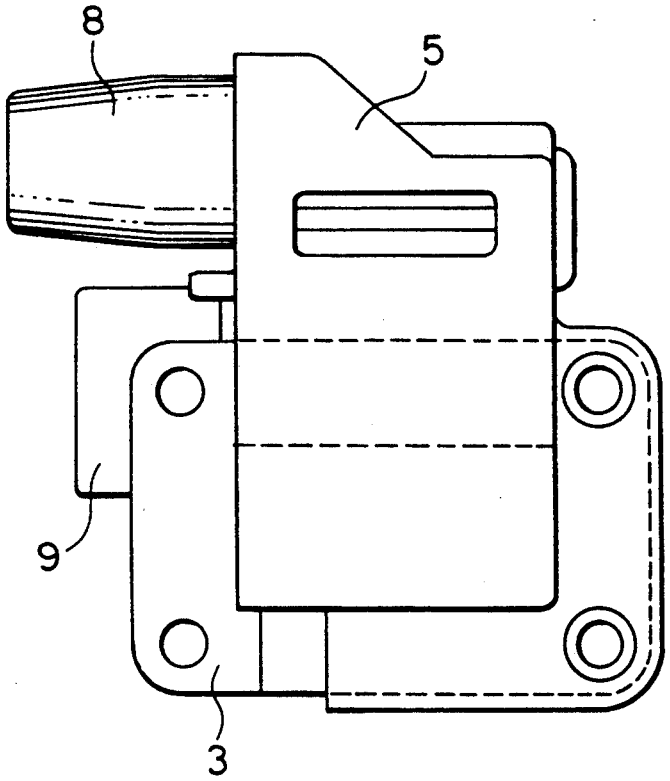
FIG. 11 is a view similar to that of FIG. 4, but showing still another ignition coil device.
Figure 12:
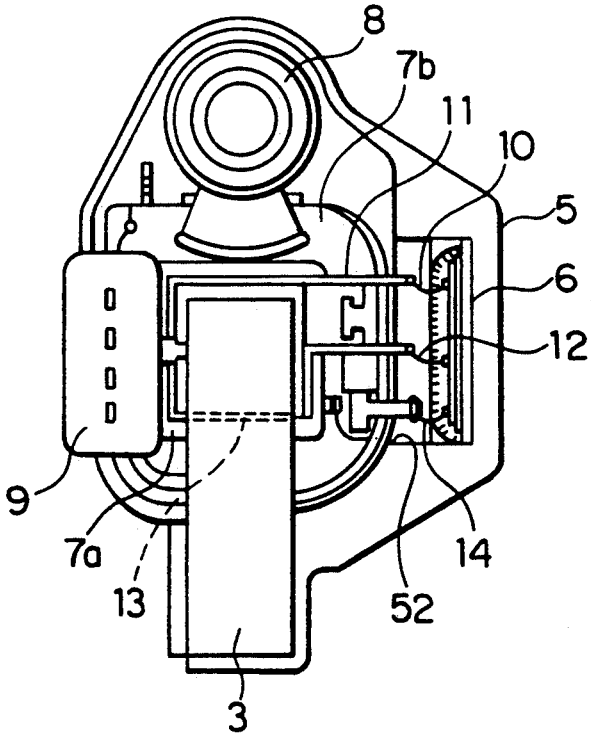
FIG. 12 is a schematic sectional end view of the ignition coil device of FIG. 11.
Figure 19:
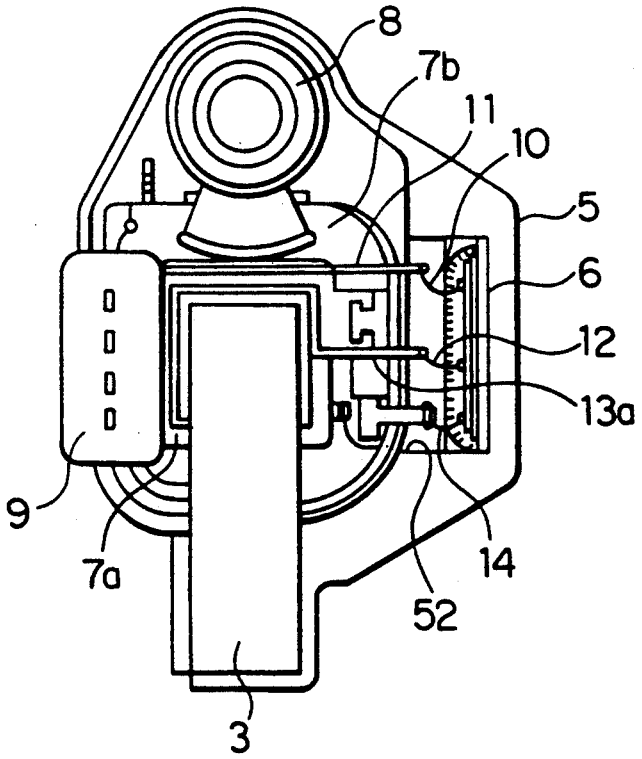
FIG. 19 is a schematic side view of another embodiment according to this invention by which the adverse effects of the flux of the core on the interior wiring is prevented.

FIG. 19 is a schematic side view of another embodiment according to this invention by which the adverse effects of the flux of the core on the interior wiring is prevented. The ignition coil device is similar to that of FIGS. 11 and 12, wherein like parts are designated by like reference numerals and the description thereof is omitted.

In FIG. 19, the ground line 13*a*, constituting an interior wiring for connecting the second terminal 12 to the connector 9, extends outside of the core 3 to connect the second terminal 12 to the connector 9. The interior wirings coupled to the respective terminals 10, 12 and 14 are all disposed outside of the core 3 and do not link with the flux generated in the core 3. Thus, no voltage is induced in the interior wirings by the flux in the core. In particular, no voltage is induced in the ground line 13*a*. Thus, the power transistor unit or igniter 6 is immune to errors occasioned by voltage induced by the magnetic flux of the core 3.

What is claimed is:

1. An ignition coil device for an internal combustion engine, comprising:

a mold resin casing enclosing an accommodating chamber and a pocket portion at a side of the accommodating chamber;

a coil assembly accommodated within said accommodating chamber of the mold resin casing;

a control circuit unit for controlling said coil assembly, disposed in said pocket portion of the mold resin casing, wherein an air gap is formed between said accommodating chamber and said control circuit;

a core carrying said coil assembly wound thereon, said core having a leg exposed outside of said mold resin casing; and a heat sink extending within said pocket, said heat sink having a first end in thermal contact with said control circuit unit, and a second end attached to said exposed leg of said core.

2. An ignition coil device for an internal combustion engine as claimed in claim 1, wherein said mold resin casing has a window formed in a side wall of said pocket portion, and said heat sink extends between said control circuit unit and said window, where an inner surface of said heat sink maintains thermal contact with the control circuit unit and an outer surface of said heat sink is exposed to the exterior via said window.

3. An ignition coil device for an internal combustion engine, comprising:

a mold resin casing enclosing an accommodating chamber and a pocket portion at a side of the accommodating chamber, wherein an air gap is formed between said accommodating chamber and pocket portion;

a coil assembly accommodated within said accommodating chamber of the mold resin casing;

a control circuit unit for controlling said coil assembly, disposed in said pocket portion of the mold resin casing;

a core carrying said coil assembly wound thereon, said core having a leg exposed outside of said mold resin casing; and a heat sink extending within said pocket and in thermal contact with said control circuit unit, said heat sink being attached at one end thereof to said exposed leg of the core;

wherein said mold resin casing has a window formed in a side wall of said pocket portion, and said heat sink extends between said control circuit unit and said window and maintains thermal contact with the control circuit unit at an inner side surface thereof, said heat sink being exposed to the exterior via said window at an outer surface thereof.

* * * * *